United States Patent [19]

Talsma

[11] 4,039,987

[45] Aug. 2, 1977

[54] COLOR TELEVISION DISPLAY DEVICE

[75] Inventor: Tjitte Talsma, Eindhoven, Netherlands

[73] Assignee: U.S. Philips Corporation, New York, N.Y.

[21] Appl. No.: 758,477

[22] Filed: Jan. 11, 1977

[30] Foreign Application Priority Data

Jan. 16, 1976 Netherlands ..... 7600424

[51] Int. Cl.[2] ..... H01F 5/00

[52] U.S. Cl. ..... 335/213; 335/210

[58] Field of Search ..... 335/210, 212; 313/440

[56] References Cited

U.S. PATENT DOCUMENTS

| | | | |
|---|---|---|---|
| 2,455,171 | 11/1948 | Haantjes | 335/213 |
| 2,617,059 | 11/1952 | Neeteson | 313/440 |
| 2,925,527 | 2/1960 | Marley | 313/440 X |
| 3,731,241 | 5/1973 | Coupland | 335/213 |

*Primary Examiner*—George Harris

*Attorney, Agent, or Firm*—Frank R. Trifari; Henry I. Steckler

[57] ABSTRACT

A color television display device in which, in order to eliminate given convergence errors, the line deflection coils are shaped so that the axes of the two gaps between these coils intersect the horizontal symmetry plane of the display tube, the one axis extending from the top to the bottom, viewed from the rear in the forward direction, while the other axis extends from the bottom to the top.

2 Claims, 4 Drawing Figures

COLOR TELEVISION DISPLAY DEVICE

Figure 1:
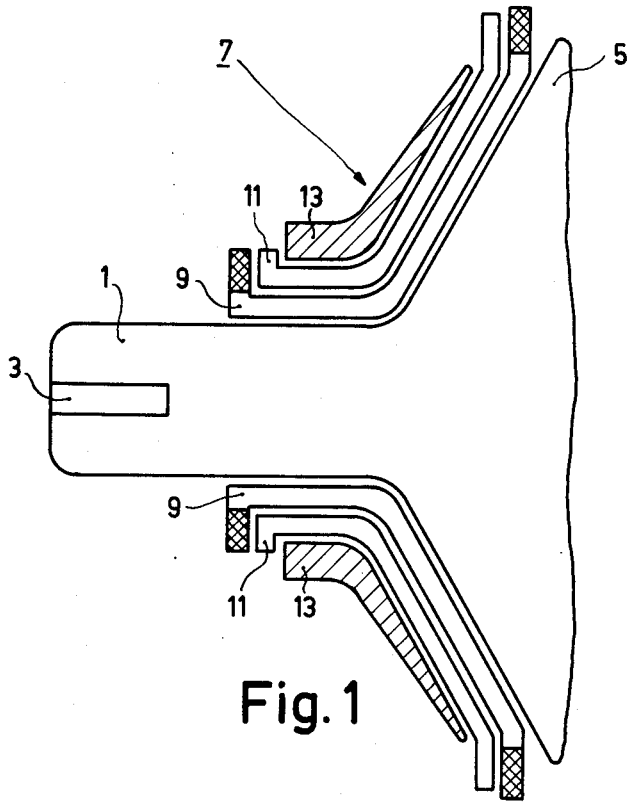

The invention relates to a colour television display device, comprising a display tube of the shadowmask type which comprises a rearmost, cylindrical portion which accommodates a device for generating three electron beams which extend in a common horizontal plane, and a foremost, flared portion, and also comprising a deflection system which is coaxially arranged about the tube near the transition between the two portions and which comprises two diametrically arranged saddle-shaped line deflection coils which serve for the horizontal deflection of the electron beams and which are separated from each other by a left gap and a right gap.

From the publication "Philips Product Information" No. 58, dated Feb. 1, 1974, pages 12 and 13, it is known that in such a device deviations may occur which can be eliminated by vertical displacement of the outer electron beams in opposite directions. This publication also states that a displacement of this kind can be realized by exciting the two line deflection coils or the two frame deflection coils by mutually different currents. For this purpose, the circuits including these coils require facilities which have a cost-increasing effect and which must be separately adjusted, which is a time-consuming operation.

The invention has for its object to realize displacement of the two outer electron beams in the desired direction without special facilities being required in the said circuits. To this end, the device in accordance with the invention is characterized in that the axes of the two gaps between the line deflection coils intersect the horizontal symmetry plane of the display tube, the axis of one of the gaps extending above this symmetry plane near its rearmost end and below this symmetry plane near its foremost end, the axis of the other gap extending below the symmetry plane near its rearmost end and above the symmetry plane near its foremost end.

The invention is based on the recognition of the fact that the said deviations cannot only be corrected by a magnetic four-pole field (like in the known device), but also by the twisting of the horizontal symmetry plane of the line deflection field; this can be realized by the described steps in accordance with the invention.

If saddle coils are also provided for the vertical deflection, similar considerations result in a further embodiment of the invention which is characterized in that the axes of the two gaps between the frame deflection coils extend at least qualitatively in the same manner relative to the vertical symmetry plane of the display tube as the axes of the two gaps between the line deflection coils extend relative to the horizontal symmetry plane.

The invention will be described in detail hereinafter with reference to the drawing.

Figure 2:
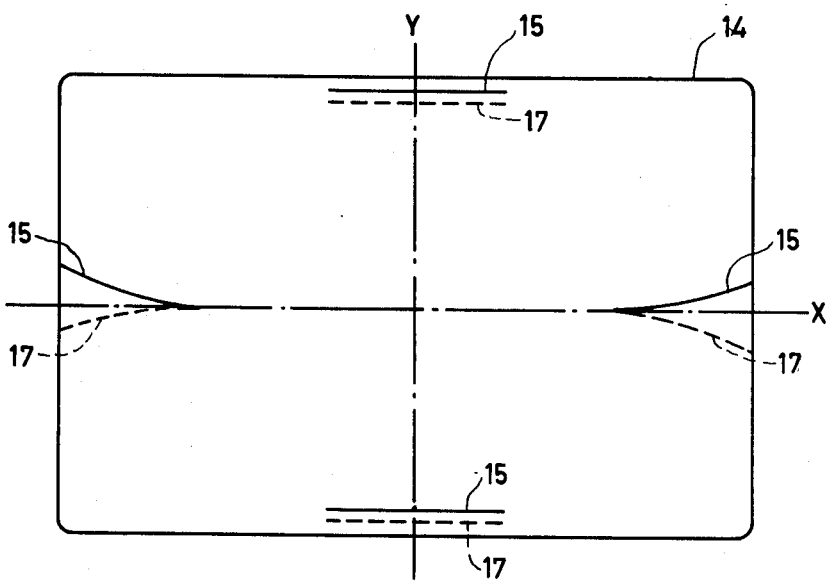
Figure 3:
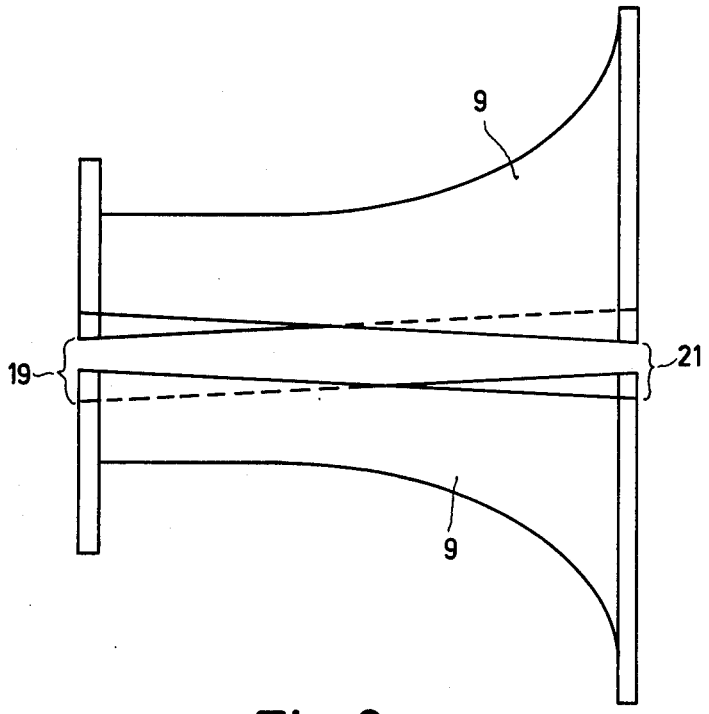
Figure 4:
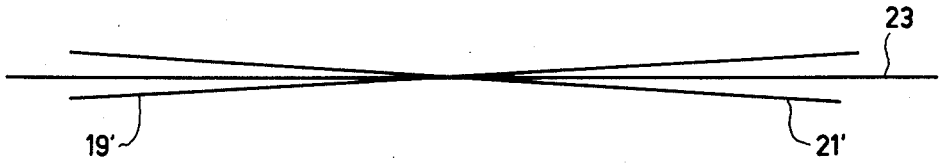

FIG. 1 is a diagrammatic longitudinal sectional view of a part of a colour television display tube comprising a deflection system, FIG. 2 shows a display screen on which the errors are visible which are removed in accordance with the invention, FIG. 3 is a side elevation of a set of deflection coils in accordance with the invention, and FIG. 4 shows the position of the axes of the gaps present between the coils of FIG. 3.

The colour television display tube shown in FIG. 1 comprises a rearmost, cylindrical portion 1, accommodating three adjacent electron guns 3, and a foremost, flared portion 5 which accommodates a colour selection electrode (shadow mask) and a display screen (not shown in FIG. 1.). Coaxially with the axis of the tube there is arranged a deflection system 7 which is present at the area of the transition between the rearmost portion 1 and the foremost portion 5 of the tube. The deflection system 7 comprises a set of saddle-shaped line deflection coils 9 for the deflection in the horizontal direction of the electron beams generated by the electron guns 3, a set of saddle-shaped frame deflection coils 11 for the deflection in the vertical direction, and a ferromagnetic ring core 13 which encloses both sets of coils.

FIG. 2 shows an example of errors which may occur when horizontal white lines are displayed on the display screen 14 by means of a known deflection system and no further steps are taken. Each white line is composed of a red, a green and a blue line which must coincide. FIG. 2 shows that the blue lines 15 are situated above the red lines 17 (the green lines present between the red and blue lines are not shown for the sake of clarity). As has also been described in the said publication "Philips Product Information" No. 58, this kind of error can be corrected by displacing the two outer electron beams (i.e. the "blue" and the "red" beam) in opposite vertical directions by means of a magnetic four-pole field which can be obtained by suitable excitation of the deflection coils.

It has been found that the same result can be obtained by slightly twisting the symmetry plane of the line deflection field; this can be achieved by suitable shaping of the line deflection coils 9. This is shown in FIGS. 3 and 4. Between the two line deflection coils 9 there is present a left gap 19 and a right gap 21. In accordance with the invention, these gaps are inclined relative to the horizontal symmetry plane 23 of the display tube, so that the axis 19' of the left gap 19 extends below this symmetry plane near its rearmost end and above this plane near its foremost end, whilst the opposite is the case for the axis 21' of the right gap 21. Obviously, the error to be corrected determines whether the left axis 19' or the right axis 21' must be directed upwards.

The described correction by way of the shape of the line deflection coils can be supported by a similar choice of the shape of the frame deflection coils. Between these coils there is present an upper gap and a lower gap, the course of which is chosen so that the axis of the one gap extends to the left of the vertical symmetry plane of the display tube near its rearmost end to the right thereof near its foremost end, whilst the opposite is the case for the other gap (not shown).

The angle enclosed by the axes 19' and 21' and the horizontal symmetry plane 23 is shown in exaggerated form in FIG. 4 for the sake of clarity. In practice it has been found that an angle of 0.1° - 0.5° usually suffices. If the frame deflection coils also have gaps with inclined axes, the angle between these axes and the vertical symmetry plane need not be the same as the angle between the axes 19' and 21' and the horizontal symmetry plane 23. Moreover, the angle between an axis and the relative symmetry plane need not always be constant over the entire length of the axis: the axis may also include bends or kinks.

What is claimed is:

1. A colour television deflection device for a display tube of the shadow-mask type which comprises a rearmost cylindrical portion which accommodates a device for generating three electron beams which extend in a common horizontal plane, and a foremost flared portion, said deflection device being adapted to be coaxially arranged about the tube near the transition between the two portions, said deflection device comprising two diametrically arranged saddle-shaped line deflection coil means for the deflection of the electron beams in the horizontal direction and which are separated from each other by a left gap and a right gap, the axes of the two gaps between the line deflection coils intersect the horizontal symmetry plane of the display tube, the axis of one of the gaps extending above this symmetry plane near its rearmost end and below this symmetry near its foremost end, the axis of the other gap extending below the symmetry plane near its rearmost end and above this plane near its foremost end.

2. A deflection device as claimed in claim 1, further comprising two diametrically arranged saddle-shaped frame deflection coil means for the deflection of the electron beams in the vertical direction and which are separated from each other by an upper and a lower gap, the axes of the two gaps between the frame deflection coils extend at least qualitatively in the same manner relative to the vertical symmetry plane of the display tube as the axes of the two gaps between the line deflection coils extend relative to the horizontal symmetry plane.

* * * * *